US006599165B1

(12) United States Patent
Van Dan Elzen

(10) Patent No.: US 6,599,165 B1
(45) Date of Patent: Jul. 29, 2003

(54) YO-YO HAVING AN ACTIVE STARBURST TETHER ENGAGEMENT SYSTEM

(76) Inventor: Hans W. Van Dan Elzen, P.O. Box 0685, Scottsdale, AZ (US) 85252

( * ) Notice: Subject to any disclaimer, the term of this patent is extended or adjusted under 35 U.S.C. 154(b) by 0 days.

(21) Appl. No.: 10/237,307

(22) Filed: Sep. 9, 2002

(51) Int. Cl.[7] ..... A63H 1/30
(52) U.S. Cl. ..... 446/250; 446/247; 446/236
(58) Field of Search ..... 446/235, 236, 446/247, 248, 253, 250

(56) References Cited

U.S. PATENT DOCUMENTS

| | | | | |
|---|---|---|---|---|
| 3,201,895 A | | 8/1965 | Stivers | |
| 3,256,635 A | | 6/1966 | Radovan | |
| 4,130,962 A | | 12/1978 | Ennis | |
| 4,332,102 A | | 6/1982 | Caffrey | |
| 4,895,547 A | * | 1/1990 | Amaral | 446/250 |
| 5,017,172 A | * | 5/1991 | Seifert | 446/250 |
| 5,389,029 A | * | 2/1995 | McAvoy, Jr. | 446/250 |
| 5,813,898 A | | 9/1998 | Van Dan Elzen et al. | |
| 5,984,759 A | | 11/1999 | O'Sullivan | |
| 6,004,183 A | * | 12/1999 | Dixon et al. | 446/250 |
| 6,196,891 B1 | * | 3/2001 | Jamison | 446/250 |

OTHER PUBLICATIONS

Four sheets of photos (labeled figs. 1–5) of SPINTASTICS "Spin–Wizard" yo–yo sold in US in 1999.

* cited by examiner

*Primary Examiner*—Derris H. Banks
*Assistant Examiner*—Bena B. Miller
(74) *Attorney, Agent, or Firm*—Franklin L. Gubernick

(57) ABSTRACT

The invention is a yo-yo that employs an active starburst tether engagement system located in one or both of the yo-yo's side members. The system makes use of a starburst-shaped array of movable engagement ribs that face the tether and are located near the yo-yo's axle structure. Each rib is independently movable and is located at the end of a flexible finger that enables the rib to be moved by the tether in a direction substantially parallel to the yo-yo's axis of rotation.

21 Claims, 6 Drawing Sheets

YO-YO HAVING AN ACTIVE STARBURST TETHER ENGAGEMENT SYSTEM

FIELD OF THE INVENTION

The invention is in the field of user-manipulated toys. More particularly, the invention is an apparatus in the form of a yo-yo that functions in an improved manner relative to the prior art. This is achieved through the use of an active starburst tether engagement system located in one or both of the yo-yo's side members. The system makes use of a starburst-shaped array of movable engagement ribs that face the tether and are located proximate the yo-yo's axle structure. Each of said ribs is independently movable and is located at the end of a flexible finger that enables the rib to move in a direction substantially parallel to the yo-yo's axis of rotation. In one embodiment, the flexible finger members, and their associated engagement ribs, are secured to a common support ring. In a second embodiment of the invention, the flexible fingers are integral with the associated side member whereby the side member and flexible fingers are in the form of a unitary part.

BACKGROUND OF THE INVENTION

Most yo-yos are in the form of two disk-shaped side members that are rigidly connected to each other by some form of axle structure. The axle structure may be an assembly of multiple parts, or merely be in the form of a dowel or a riveted pin, and may be made of metal and/or wood and/or plastic. In many modern yo-yos, the axle structure includes a center-located bearing or other member that is secured to, and rotatable on, an elongated axle member.

The axle structure also forms an anchor for one end of a string-type tether. This is accomplished by having the tether's end-located loop encircle a portion of the axle structure.

The free end of the tether is usually tied to create a loop. This loop is normally placed about one of a user's fingers to thereby secure the yo-yo to the user. When the tether is wound about the axle structure and the yo-yo is released from the user's hand, the yo-yo will begin to rapidly spin as it moves away from the user's hand and the tether unwinds from the axle structure. Once the tether is fully unwound, the yo-yo may "sleep" at the end of the tether, whereby the yo-yo continues to spin without the tether rewinding on the axle structure.

Once the yo-yo is sleeping, there are a number of tricks that a person can perform with the spinning yo-yo. In some of these tricks, the spinning yo-yo is temporarily placed upon a portion of the tether intermediate of the tether's two ends. At the completion of most yo-yo tricks, the user will make a rapid tug/jerk on the tether. This will result in a brief tightening of the tether, which is then automatically followed by a temporary slackening of the tether. Once the tether goes slack, the tether's twist will cause one or more portions of the tether to move and thereby contact a spinning portion of the yo-yo. Once contact has occurred, the tether portion can become snagged on a spinning portion of the yo-yo and this will cause the tether to wind about the axle structure. The winding of the tether on the axle structure causes the yo-yo to return to the user's hand.

There are three crucial performance characteristics of a yo-yo that enable a user to perform yo-yo tricks. The yo-yo must be capable of sleeping for an extended period of time, it should return on command, and it should be smooth on the tether.

Concerning a yo-yo's sleep time, the longer the yo-yo can be made to sleep, the more time the user will have to complete any particular yo-yo trick. It is well known that by minimizing friction in the yo-yo's components, one can maximize the yo-yo's sleep time. It is also known that whenever the tether even slightly rubs against a spinning portion of the yo-yo, the created friction will also reduce the yo-yo's sleep time.

For a yo-yo to return on command, the structure and design of the yo-yo must be such that when the user causes the tether to briefly go slack, a portion of the tether can snag a spinning portion of the yo-yo. The ability of the tether to snag one of the yo-yo's spinning side members is often enhanced through the use of particular adaptations in the tether-facing surface of said side members. A commonly employed adaptation of this type is the use of a starburst-shaped array of rigid, fixed ribs that extend toward the tether from each side member's tether-facing surface. The tether-facing surface of a side member is herein defined as the surface of the side member that is normally oriented substantially perpendicular to the yo-yo's axis of rotation and that faces a portion of the yo-yo's tether at all times. While the ribs facilitate tether engagement, they also make it is easy for a user to inadvertently cause the tether to rub on the ribs during a yo-yo trick. This can result in an unplanned return of the yo-yo to the user's hand, or less dramatically, increase tether wear and reduce sleep time.

Concerning a yo-yo's ability to be smooth on the tether, this refers to a yo-yo's ability to be temporarily placed on a middle portion of the tether without the tether inadvertently snagging a spinning portion of the yo-yo. If during a trick, the tether snags a spinning portion of the yo-yo at the wrong moment, the yo-yo will immediately return to the user's hand and the trick will be ruined. The tendency of the tether to inadvertently snag on a spinning portion of the yo-yo is affected by the yo-yo's string gap, the configuration of each side member's tether-facing surface and the configuration of the yo-yo's axle structure.

A yo-yo's string gap is herein defined as the area between the yo-yo's side members. The larger the width of the string gap proximate the axle structure, the further the tether has to travel to snag on either of the side members. However, too wide a gap may preclude a user's ability to cause the tether to engage a spinning portion of the yo-yo, with the result that a user cannot make the yo-yo return to his or her hand.

One other consideration involved in the design/performance of yo-yos is the wear rate of the yo-yo's tether and the components used to engage said tether. It is a common occurrence for a tether to wear out over time. This is due both to the physical strains put on the tether during use of the yo-yo, and to the wear that occurs whenever the tether contacts a spinning portion of the yo-yo. A tether will normally wear out long before significant wear occurs in the tether engagement structure. However, once significant wear occurs in the yo-yo's tether engagement structure, the yo-yo's performance will degrade and the yo-yo will eventually become unusable.

SUMMARY OF THE INVENTION

The invention is an improved yo-yo in which a unique tether engagement structure is employed to facilitate and control tether engagement. The yo-yo features at least one side member that employs an active starburst tether engagement system. The system features a starburst-shaped array of movable engagement ribs that are flexibly secured to the associated side member. This is unlike prior art yo-yos that employ a fixed set of raised ribs located in a starburst-shaped array. It should be noted that the term "starburst-shaped" is herein defined as a plurality of ray-like members that are spaced about, and extend away from, a center point.

Most of the time, the movable engagement ribs protrude outwardly from a substantially planar, tether-facing surface of the associated side member. The ribs are located proximate, and preferably adjacent to, the yo-yo's axle structure. In the preferred embodiment, each of the ribs has a triangular shape, with linear edges.

In some situations, the movable engagement ribs are moved by the tether in a direction that is substantially parallel to the yo-yo's axis of rotation and is also substantially perpendicular to the side member's tether-facing surface. This is enabled through the use of flexible finger members that are secured to, and preferably extensions of, the ribs. Each flexible finger member has an elongated shape with a relatively narrow cross-section. These characteristics, in combination with the material used to make the finger members, gives each finger member a degree/amount of flexibility. In the preferred embodiment, the finger members are made of a flexible plastic material. Other materials may alternatively be employed, with material choice being made in combination with any flexibility that is derived through the shape of the fingers to preferably enable the finger members to act as springs and to exhibit considerable bending moment. It should be noted that changes made in the material or shape of the finger members could affect the yo-yo's performance.

In a first embodiment of the invention, all of a side member's flexible finger members are attached to a common support ring. The ring is preferably releasably secured to a back portion of the associated side member. To enable the engagement ribs to protrude into the string gap, the side member's tether-facing surface includes a plurality of shaped apertures through which the ribs pass. The finger members thereby spring-bias the ribs toward the tether.

In a second embodiment of the invention, all of a side member's flexible finger members and attached engagement ribs, as well as the side member itself, are in the form of a unitary part. This requires the side member to be made of a material, such as plastic, that will enable the flexible fingers to flex and thereby spring-bias the engagement ribs toward the tether.

The operation of the active starburst tether engagement system is most noticeable during the performance of yo-yo tricks. When the yo-yo is sleeping at the end of the tether, the tether's end loop will normally be centered on the axle structure and the tether will preferably be spaced from the engagement ribs of both side members. At this point, there is no impetus for the yo-yo to return to the user's hand since there is no contact between the tether and the ends of the engagement ribs.

During the performance of most yo-yo tricks, the yo-yo will be manipulated through movement of the tether. Until the very end of the trick, a user must take care not to have the tether contact a spinning portion of the yo-yo, lest the yo-yo should be caused to inadvertently return or be slowed to the extent that it cannot return at the end of the trick. While the invention does not prevent inadvertent tether contact with a side member, it ameliorates the problem.

In the invention, the active starburst tether engagement system allows for some movement of the engagement ribs. When the tether is in a taut condition and a user inadvertently causes the tether to contact one or more of the ribs, the resultant slight pressure on the rib(s) causes the rib(s) to move away from the tether. In this manner, a glancing contact will not cause an immediate return of the yo-yo. While such a glancing contact will cause some slowing of the yo-yo, the ability of the ribs to move away from the tether will minimize the braking action of the contact. It should be noted that by allowing the ribs to move away from the tether, any inadvertent contact will produce much less wear in both the tether and the ribs than would be caused if the ribs were not movable.

When the user is ready to have a yo-yo in accordance with the invention return to his or her hand, the user causes the tether to go slack in the same manner that is used with prior art yo-yos. Once the tether is slack, it will tend to move toward one or both of the yo-yo's side members. Since the slack tether cannot exert any significant pressure on the movable engagement ribs, the ribs will not move away from the tether and they will snag the tether and cause the yo-yo to return to the user's hand.

Since the tether will only tend to lockably snag one of the yo-yo's movable ribs when the tether has been purposefully slackened by the user, it is possible for the ribs to protrude further into the string gap than is usually found in prior art yo-yos having fixed ribs. Having the ribs protrude further into the string gap makes it easier for a user to cause the yo-yo to return and also provides the yo-yo with a faster response time.

The invention enables a yo-yo to perform in an extremely responsive manner while at the same time minimizing the adverse affects that would follow an inadvertent contact between the tether and one of the yo-yo's side members. In this manner, a yo-yo in accordance with the invention will be able to sleep longer and be smoother on the string than prior art yo-yos. Concerning the ability of the yo-yo to return on command, the yo-yo's design can enable the ribs to protrude further into the string gap and thereby make it easier to cause the yo-yo to return while providing the yo-yo with a quicker response time.

DETAILED DESCRIPTION OF THE DRAWINGS

Figure 1:
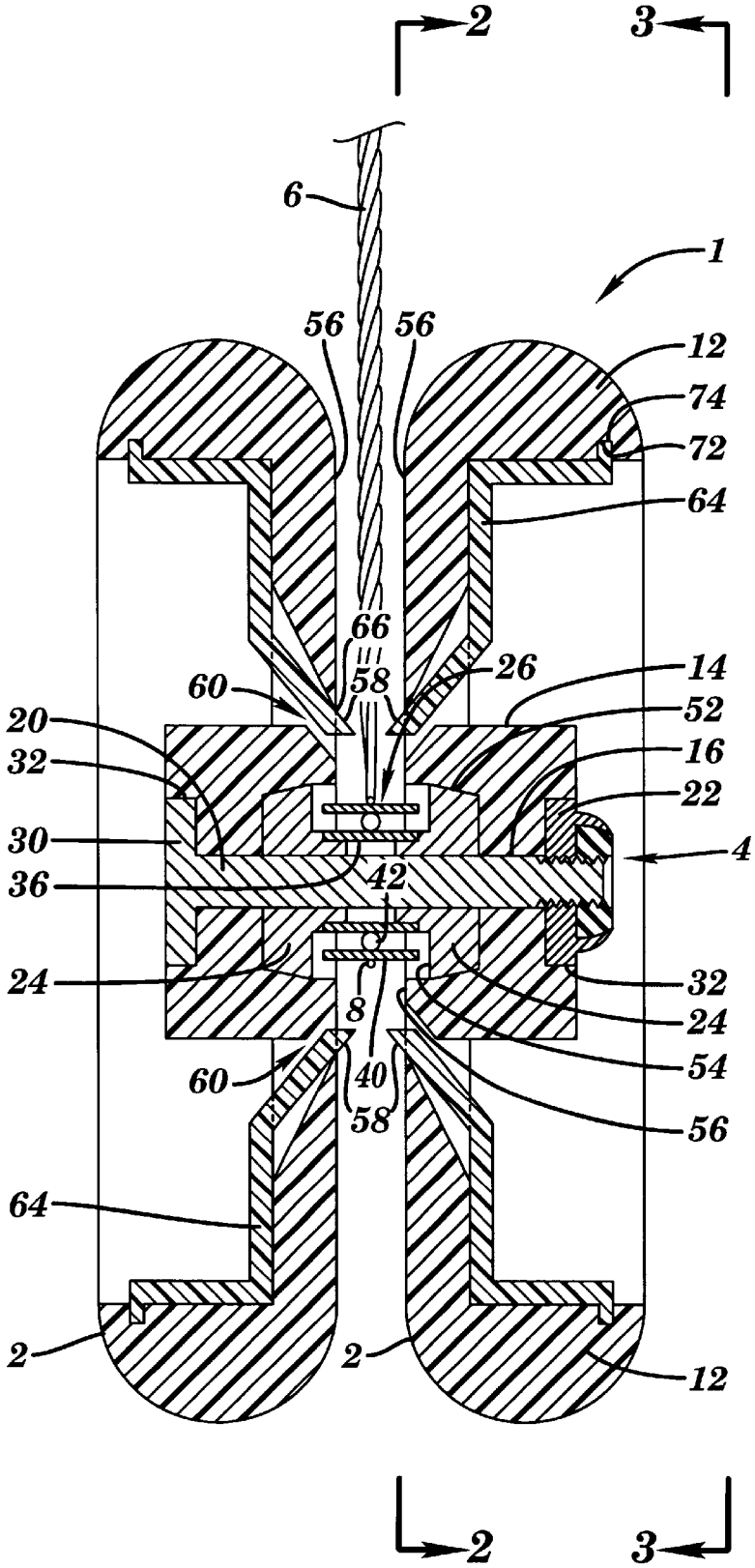
FIG. 1 is a cross-sectional view of a first embodiment of a yo-yo in accordance with the invention.

Referring now to the drawings in greater detail, wherein like characters refer to like parts throughout the several figures, there is shown by the numeral 1 a yo-yo in accordance with a first embodiment of the invention.

The yo-yo 1 includes first and second disk-shaped side members 2 that are connected together via an axle structure 4. A string-type tether 6 includes a loop portion 8 that encircles a center portion of the axle structure. The tether's distal end (not shown) will normally be tied to create a loop to enable temporary securement to one of a user's fingers.

Each side member 2 includes an annular rim portion 12 that is attached to, and encircles, a hub portion 14. Most of the side member's weight is concentrated in the rim portion to thereby provide the yo-yo with favorable balance and spin characteristics. The center of the hub portion includes a thru-bore 16 through which a portion of the axle structure extends. In the preferred embodiment, each side member is made of a rigid material such as wood, plastic or metal. Alternatively, the side members can be made of a non-rigid material, or a combination of rigid and non-rigid materials.

The axle structure 4 is an assemblage of parts that includes an axle pin 20, a nut 22, two spacers 24 and a ball bearing unit 26. The axle pin is preferably in the form of a hex head bolt in which the head 30 is non-rotatably secured within a hexagonally-shaped complementary cavity 32 formed in the hub 14 of the left-hand side member 2. The right-hand side member 2 preferably also includes a hexagonally-shaped cavity 32 into which is snugly, and non-rotatably, received the hexagonally-shaped nut 22. The nut 22 is preferably a locknut that is threadedly engaged to a threaded portion of the pin 20 to thereby secure the two side members 2 together. If one desires to disassemble the yo-yo, the nut 22 can be unscrewed from the pin 20 by rotation of either of the yo-yo's side members 2 relative to the other. It should be noted that other conventional types of connectors, such as a dowel, rivet, or a rod threaded at both ends, may be used in place of the above-described nut and bolt.

The ball bearing unit 26 is preferably conventional in design and comprises an inner race 36, an outer race 40 and a plurality of ball bearings 42 located therebetween. The axle pin 20 passes through the center of the ball bearing unit when the yo-yo is in an assembled condition. It should be noted that the ball bearing unit can be replaced by other types of rotatable units, including transaxles, or be dispensed with when the yo-yo employs a fixed-axle that does not employ any relatively movable parts.

Each spacer 24 includes a thru-hole through which the axle pin 20 passes. When the yo-yo is assembled, the spacers 24 are received within identical cavities 52 in their respective side members 2. The cavities 52 are complementary in size and shape to the outer-facing surfaces of the spacers. Once in place, the spacer's inner-facing surface 54 contacts the bearings inner race 36, but does not contact the bearing's outer race 40. It should be noted that the surface of the outer race is substantially perpendicular to the tether-facing surface 56 of each side member and does not contact either of the side members. Since the bearing's outer race does not contact the spacers or the side members, it is free to spin and can therefore move independently of the side members.

To facilitate the return of the yo-yo, each side member is shown having an active starburst tether engagement system. The system includes a plurality of movable engagement ribs 58 that protrude into the yo-yo's string gap. The ribs are oriented in a starburst-shaped array about the center of the side member and extend through complementary apertures 60 in the associated side member's tether-facing surface. A rib is herein defined as any structure that is capable of snagging a portion of the tether.

Figure 2:
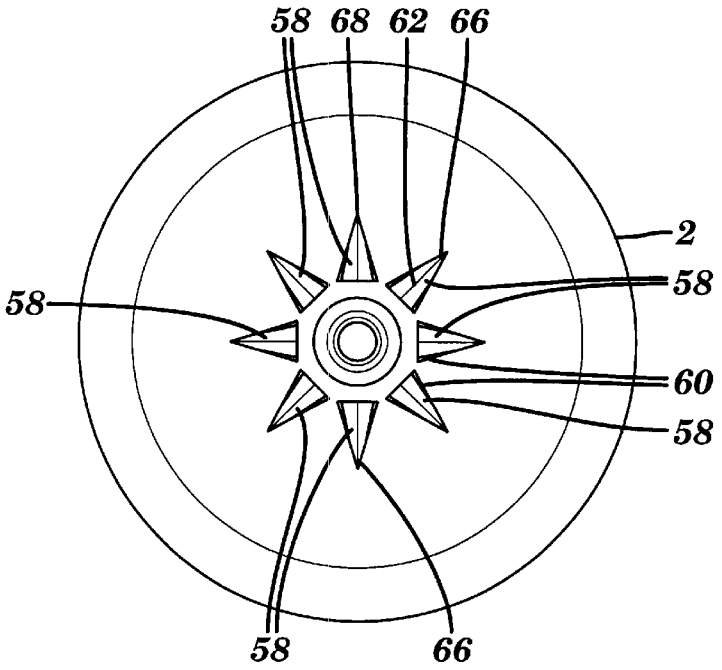
FIG. 2 is an elevation view of the tether-facing surface of one of the side members of the yo-yo shown in FIG. 1, taken from the plane labeled 2—2 in FIG. 1.

FIG. 2 provides a view of the tether-facing surface of the right-hand side member 2 of the yo-yo shown in FIG. 1. The tether-facing surface of the other side member is identical to that shown. As can be seen in the figure, each rib 58 is preferably somewhat triangular in shape and preferably includes a linear edge 62 to facilitate engagement with the tether. Since the apertures 60 are complementary in size and shape to the ribs, they are also triangular in shape. Side-to-side movement of the ribs is prevented by having the dimensions of the apertures only minimally greater than those of the ribs.

Each rib is secured to, and forms the end of, an elongated finger member 64. The finger members are preferably made of a material that provides some inherent flexibility, such as plastic or metal. The elongated shape of each finger member is preferably also partially responsible for the finger member's flexibility.

When each rib 58 is inserted through its associated aperture 60 in the side member, area 66 of the rib will preferably contact the aperture's apex 68. In this manner, the rib 58 is limited in the extent to which it can protrude into the yo-yo's string gap. This contact may cause the flexible finger member 64 to become slightly flexed in a direction away from the tether, thereby applying a pre-load on the finger member.

Figure 3:
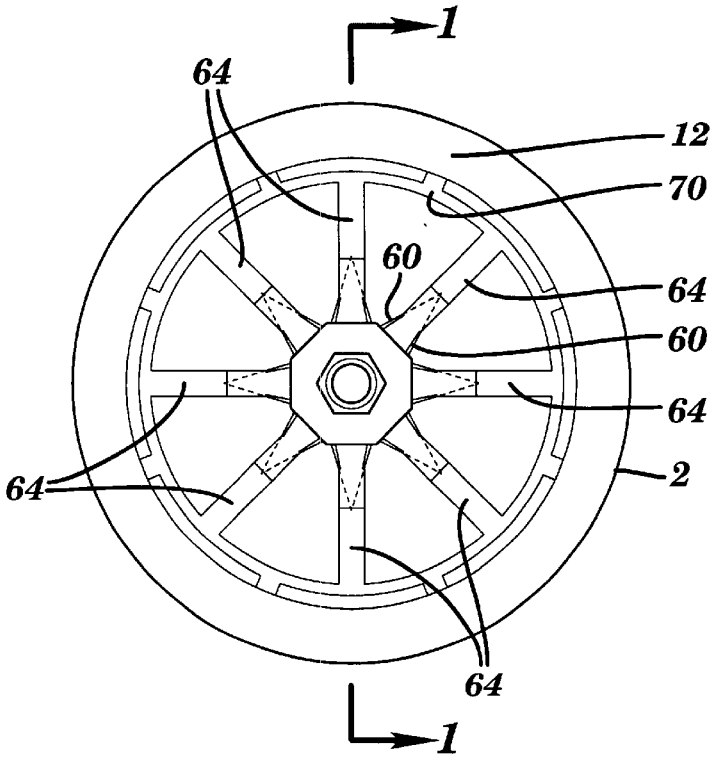
FIG. 3 is a side view of the yo-yo shown in FIG. 1.

FIG. 3 provides a side view of the yo-yo shown in FIG. 1. In the figure, one can see that all of the flexible finger members 64 of the side member are attached to a common support ring 70. As can be seen in FIG. 1, the support ring includes an outer flange portion 72 that is received within a complementary groove 74 in the side member's rim portion 12. This engagement between flange portion 72 and groove 74 firmly secures the support ring to the side member.

Figure 4:
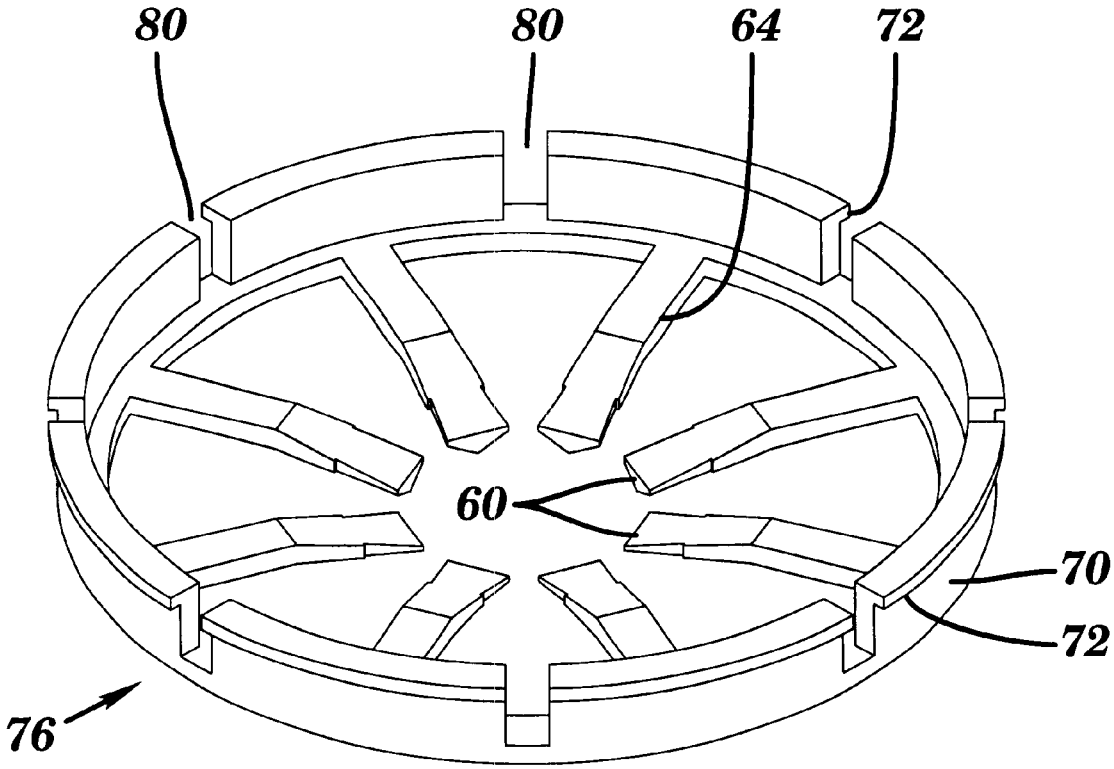
FIG. 4 is a perspective view of one of the flexible finger units employed in the yo-yo shown in FIG. 1.

The engagement ribs 58, flexible finger members 64 and support ring 70 are preferably in the form of a unitary flexible finger unit 76. FIG. 4 provides a perspective view of the flexible finger unit 76. As can be seen in the figure, the unit's support ring 70 includes a plurality of gaps 80. These gaps facilitate the unit's removal from, or insertion into, a yo-yo's side member by enabling a slight amount of dimensional flexibility in the support ring.

The operation of the active starburst tether engagement system will now be described. In FIG. 1, the yo-yo is shown at the end of the tether, with the tether at a central location where it is spaced from all of the ribs 58. If the yo-yo is sleeping, the yo-yo will continue to spin without any impetus to return to the user's hand.

Figure 5:
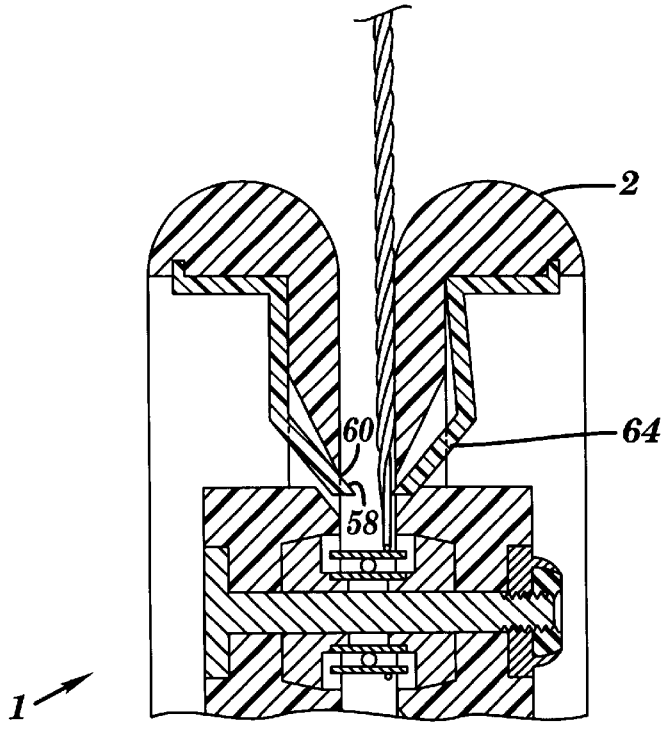
FIG. 5 is a cross-sectional, detailed view of a portion of the yo-yo shown in FIG. 1, showing the yo-yo at a time when the tether has moved to the side and is causing the engagement ribs to move outwardly.

FIG. 5 shows a portion of the yo-yo during the performance of a yo-yo trick wherein the user has caused the tether to move toward the right-hand side member 2. The taut tether is pressing against the side member's ribs 58 and has caused said ribs to move a slight distance to the right. One should note that the movement has been enabled through a flexing of the associated finger members 64 in a direction away from the tether. This first type of engagement between the tether and the ribs is causing some friction with a resultant slight slowing of the yo-yo, but there is insufficient contact pressure to significantly slow the yo-yo. By allowing the ribs to "give" in response to pressure exerted on them by contact with the tether, they brush on, but do not snag, the tether. This is unlike the prior art wherein the same contact pressure between the tether and one of the yo-yo's ribs would cause the tether to become snagged by one or more of the ribs, leading to an immediate return of the yo-yo to the user's hand.

To understand how the invention, and in fact most conventional yo-yos, can be made to return, it is important to understand how the tether is made. To create a conventional yo-yo tether, a long flexible string, preferably made of cotton, is folded in half and the two halves/strands 82 and 84 of the string (note FIG. 6) are twisted together in a helical configuration. When the yo-yo is sleeping at the end of the tether, the weight of the yo-yo puts a stress on the tether, thereby causing the strands to remain tightly twisted together. To get the yo-yo to return, a user moves his or her hand to cause a single jerk/tug on the tether. In response, the yo-yo will move toward the user's hand. As the yo-yo moves toward the user's hand, the user's hand moves toward the yo-yo. This results in the tether becoming slack whereby the lack of tension in the tether allows the two strands to slightly unwind in the area near the yo-yo's axle structure. The untwisting strands move outwardly toward one or both of the side members. This condition is shown in FIG. 6.

Figure 6:
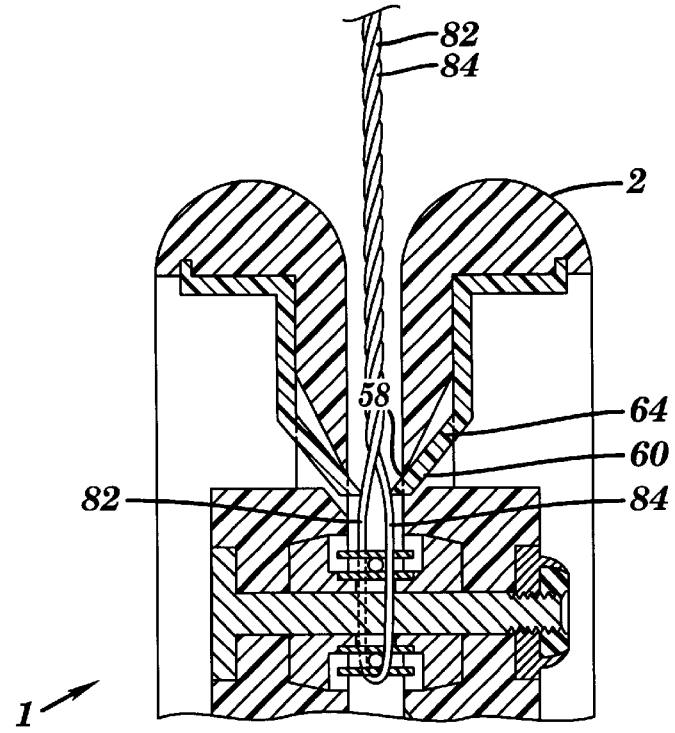
FIG. 6 is a cross-sectional, detailed view of a portion of the yo-yo shown in FIG. 1, showing the yo-yo at a time when the tether is in a slackened condition.

In FIG. 6, the tether's strands 82 and 84 are shown contacting the engagement ribs 58 of both of the yo-yo's side members. It should be noted that when the tether is in a slackened condition, the portions of the strands that have moved outwardly are extremely flexible and do not have the ability to push on any of the ribs to cause them to move in the manner shown in FIG. 5. As a result, this figure shows a different, second type of engagement between the tether and the ribs 58. Since the ribs do not move, one or both of the tether's strands 82 or 84 get snagged by one or more of the ribs 58. This results in the tether becoming locked onto the spinning side member(s) and thereby winding about the yo-yo's axle structure. As the tether winds about the axle structure, the yo-yo returns to the user's hand. The above-described engagement is basically the same as occurs with prior art yo-yos that employ conventional, non-movable engagement ribs.

It should be noted that the flexible finger unit 76 is preferably removable from the side member to allow a user to replace it with a new unit 76. In this manner, a user can replace a worn-out unit 76 with a new one. Alternatively, the user can markedly change the performance characteristics of the yo-yo by removing an existing unit 76 and replacing it with another unit 76 in which the finger members have different flexibility characteristics and/or the ribs have different shapes and/or contours and/or coefficient of friction. For example, employing a unit 76 that has relatively stiff fingers would result in a yo-yo that is less forgiving about inadvertent tether contact during the performance of a yo-yo trick, but easier to make return to the user's hand from a sleeping condition. That same unit would also make the yo-yo good for performing looping tricks. If instead, one employed a unit 76 that had relatively flexible fingers, the tendency for the yo-yo to inadvertently return would be reduced and therefore would make the yo-yo good for performing complicated string tricks. It should be noted that when a flexible finger unit 76 is employed in both of the yo-yo's side members, the flexible finger units can both be identical or can be different from each other, depending on how the user wishes to use the yo-yo.

Figure 7:
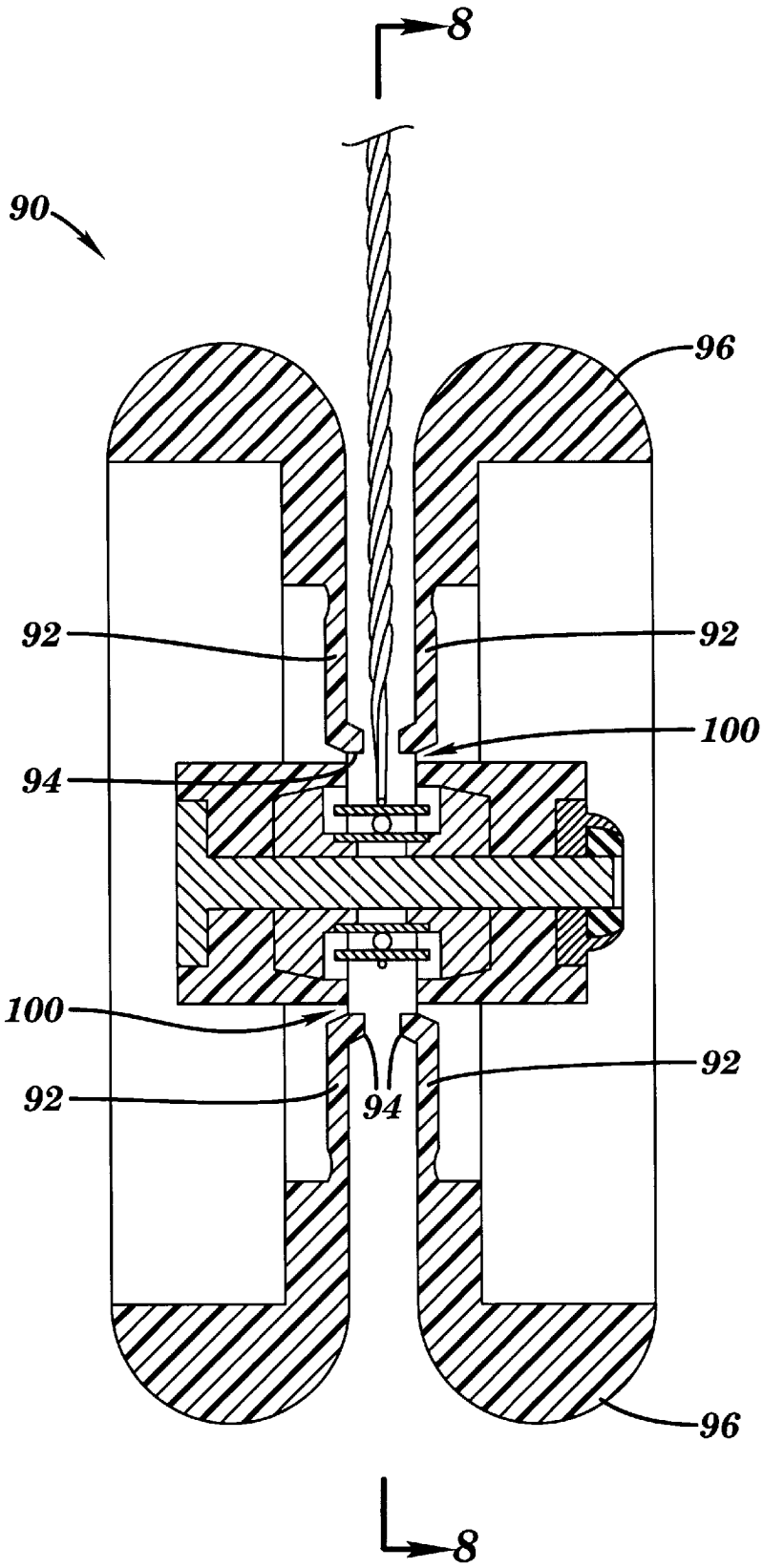
FIG. 7 is a cross-sectional view of a second embodiment of a yo-yo in accordance with the invention.
Figure 8:
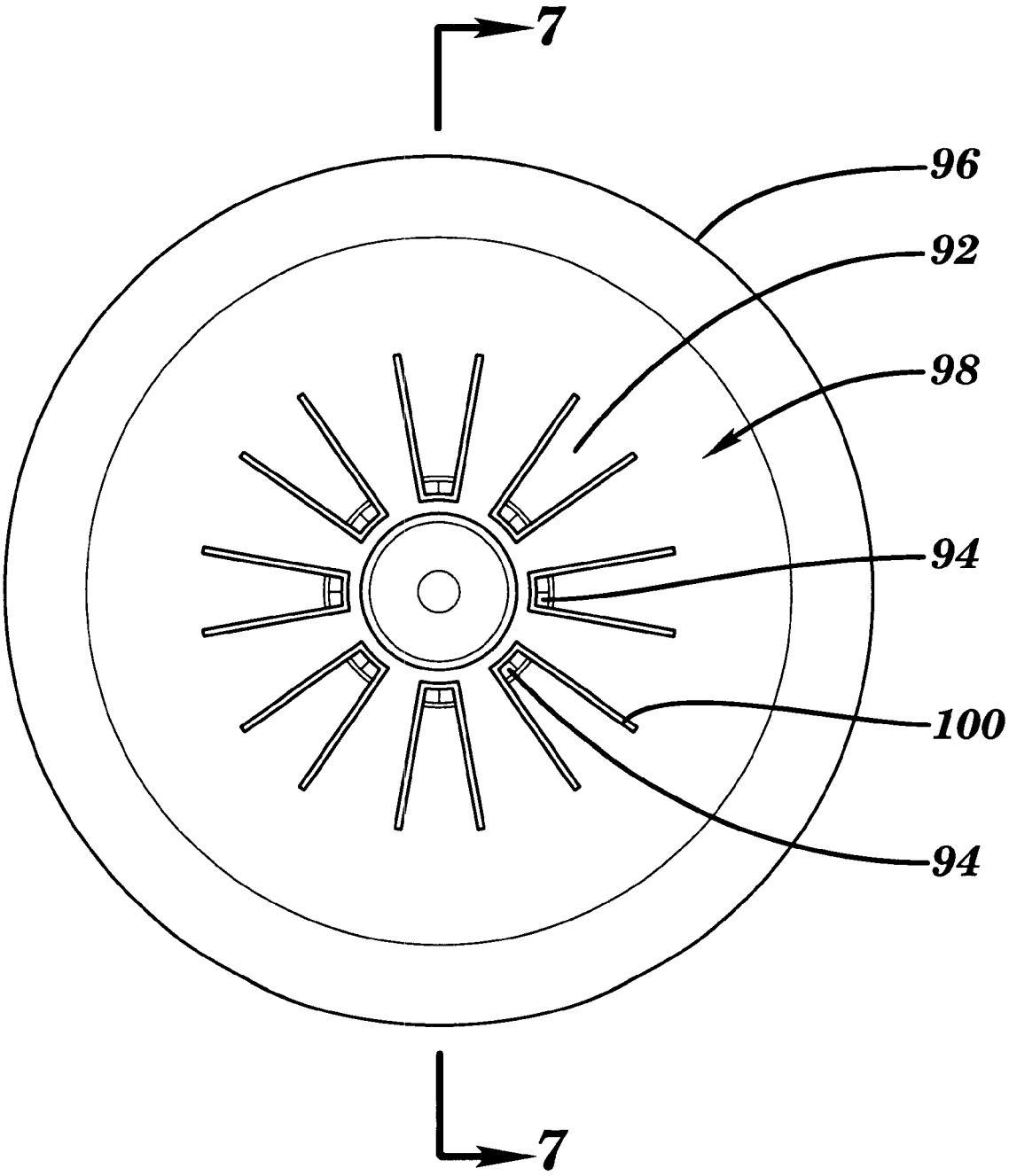
FIG. 8 is an elevation view of the tether-facing surface of one of the side members of the yo-yo shown in FIG. 7, taken from the plane labeled 8—8 in FIG. 7.

FIGS. 7 and 8 show a second embodiment of a yo-yo 90 having an active starburst tether engagement system in accordance with the invention. FIG. 7 provides a cross-sectional view of the yo-yo 90. Unlike the yo-yo 1 shown in FIG. 1, the flexible finger members 92, and the engagement ribs 94 located at the ends of the finger members, are a molded or cut-out portion of each side member 96.

FIG. 8 provides an elevation view of one of the side members taken from a plane wherein one can view the side member's tether-facing surface 98. As can be seen in the figure, there is an opening or gap 100 around each of the finger members 92.

The material of the side member 96 and the shape of the flexible finger members work in combination to allow the finger members 92, and ribs 94, to be capable of moving in the same manner as the ribs and finger members of the previously described embodiment. Since the finger members must be flexible, plastic is a preferred material for fabrication of the side member.

While not shown in the figures, it is within the scope of the invention whereby a separate spring member can be secured to the yo-yo and employed to bias said finger members 92 and ribs 94 toward the tether. For example, a spring unit, such as a rubber disk or band or a device similar to the flexible finger unit 76, could be secured to the outer side of one of the yo-yo's side members whereby it would act on the flexible finger members 92 to bias them in a direction toward the tether.

Since the flexible finger members are not a separate part from the side member, a cost saving may be realized over the previously described embodiment. However, a consequent disadvantage is that the flexible finger members and ribs are not replaceable.

It should be noted that the use of an active starburst tether engagement system, as taught herein, can be employed with other types of yo-yos than the one shown. For example, the system can facilitate tether engagement in yo-yos having other types of axle structures, or shapes of side members. It should also be noted that while eight movable engagement ribs are shown in each side member of the yo-yos shown, a greater or lesser number of movable ribs may be employed. Furthermore, while the yo-yos shown employ movable engagement ribs in both side members, it is within the scope of the invention to employ movable engagement ribs in only one side member whereby the other side member may include fixed engagement ribs, or no engagement ribs at al.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second side members secured together in a spaced-apart relation by an axle structure;

a tether secured to a portion of said axle structure;

wherein each of said side members has a tether-facing surface in which at least a portion of said surface faces toward the opposite one of said side members; and a plurality of movable engagement ribs movably secured to said first side member wherein said ribs protrude outwardly toward said tether from said first side member's tether-facing surface, and wherein when said tether is taut and contacts said ribs, said ribs will move in a direction away from said tether.

2. The yo-yo of claim 1 wherein each movable engagement rib forms an end portion of an associated flexible finger member and wherein a plurality of said flexible finger members are connected to said first side member.

3. The yo-yo of claim 2 wherein all of said flexible finger members associated with said first side member are connected to a common support member that is secured to said first side member.

4. The yo-yo of claim 3 wherein the support member is ring-shaped.

5. The yo-yo of claim 3 wherein the support member has a flange portion that is received within a complementary annular groove in said first side member to thereby secure said support member to said first side member.

6. The yo-yo of claim 5 wherein said groove is located in a rim portion of the first side member.

7. The yo-yo of claim 3 wherein the support member and its attached finger members form a flexible finger unit, and wherein said unit is removably secured to said first side member.

8. The yo-yo of claim 7 wherein the finger members of the flexible finger unit have a first predetermined amount of flexibility and wherein when said unit is removed from the first side member, it can be replaced by another flexible finger unit in which the finger members have a second predetermined amount of flexibility that is different from said first predetermined amount of flexibility and will thereby cause a change in how easy it will be for a user to have the yo-yo return from a sleeping condition.

9. The yo-yo of claim 1 wherein both side members have movable engagement ribs.

10. The yo-yo of claim 2 wherein at least one flexible finger member is made of a plastic material.

11. The yo-yo of claim 2 wherein the first side member and its associated flexible finger members are formed as a single unitary part.

12. The yo-yo of claim 1 wherein the movable engagement ribs extend through complementary apertures in the tether-facing surface of the first side member.

13. The yo-yo of claim 12 wherein said apertures are substantially triangular in shape.

14. The yo-yo of claim 1 wherein the movable engagement ribs have a substantially triangular shape.

15. The yo-yo of claim 1 wherein at least one of said movable engagement ribs is spring-biased toward the tether.

16. The yo-yo of claim 1 wherein said engagement ribs are located in a starburst-shape array about a center axis of the first side member.

17. A yo-yo comprising:

first and second side members secured together in a spaced-apart relation by an axle structure;

a tether secured to a portion of said axle structure;

wherein each of said side members has a tether-facing surface in which at least a portion of said surface faces toward the opposite one of said side members; and wherein at least one of said side members has a plurality of movable engagement ribs located in its tether-facing surface and capable of contacting said tether when at least a portion of said tether is moved toward said ribs, wherein said movable engagement ribs are flexibly secured to their associated side member in a manner whereby each of said ribs is independently movable and is capable of being moved in a direction away from said tether during a first predetermined type of engagement between said tether and said ribs, and wherein when said yo-yo is sleeping at the end of the tether, a second predetermined type of engagement between said tether and said ribs will cause the yo-yo to return to a user's hand.

18. The yo-yo of claim 17 wherein both of said side members feature a plurality of movable engagement ribs located in their tether-facing surfaces and capable of contacting said tether when at least a portion of said tether is moved toward said ribs, and wherein said ribs are located wherein they protrude into the yo-yo's string gap.

19. A yo-yo comprising:

first and second side members secured together in a spaced-apart relation by an axle structure;

a tether secured to a portion of said axle structure;

wherein each of said side members has a tether-facing surface in which at least a portion of said surface faces toward the opposite one of said side members; and wherein said first side member has a plurality of movable engagement ribs located in its tether-facing surface and capable of contacting said tether when at least a portion of said tether is moved toward said ribs, wherein said ribs are secured to a common support member that is secured to said first side member, wherein a spring member is operatively connected to at least one of said engagement ribs to thereby enable said at least one of said engagement ribs to be capable of being moved in a direction away from said tether during a first predetermined type of engagement between said tether and said ribs, and wherein when said yo-yo is sleeping at the end of the tether, a second predetermined type of engagement between said tether and said at least one of said engagement ribs will be capable of causing the yo-yo to return to a user's hand.

20. The yo-yo of claim 19 wherein the spring member is in the form of a flexible finger member.

21. The yo-yo of claim 19 wherein said engagement ribs are located whereby when the yo-yo is sleeping at the end of the tether and said tether is in a centered position between said side members, said engagement ribs will only contact said tether when said tether moves away from said centered position.

* * * * *